United States Patent [19]

Buck

[11] Patent Number: 4,932,301

[45] Date of Patent: Jun. 12, 1990

[54] CUTTING APPARATUS FOR SHEET MATERIAL, LIKE PAPER

[75] Inventor: Hermann Buck, Dettingen/Erms, Fed. Rep. of Germany

[73] Assignee: bielomatik Leuze GmbH & Co., Fed. Rep. of Germany

[21] Appl. No.: 298,209

[22] Filed: Jan. 17, 1989

Related U.S. Application Data

[63] Continuation of Ser. No. 933,030, Nov. 20, 1986, abandoned.

[30] Foreign Application Priority Data

Nov. 26, 1985 [DE] Fed. Rep. of Germany ..... 3541640

[51] Int. Cl.[5] ..... B26D 1/09; B26D 7/26

[52] U.S. Cl. ..... 83/640; 83/694; 83/698

[58] Field of Search ..... 83/582, 640, 641, 636, 83/698, 699, 700, 694

[56] References Cited

U.S. PATENT DOCUMENTS

| | | | |
|---|---|---|---|
| 432,108 | 7/1890 | Anderson | 83/700 X |
| 1,173,580 | 2/1916 | Jennings, Jr. | 83/641 |
| 1,334,391 | 3/1920 | Nilsson | 83/641 X |
| 1,601,335 | 9/1926 | Addison | 83/698 |
| 2,605,836 | 8/1952 | Messick | 83/640 |
| 3,242,786 | 3/1966 | Giordano | 83/640 X |
| 3,321,145 | 5/1967 | Gorman | 83/674 X |
| 3,797,352 | 3/1974 | Smith | 83/699 |
| 4,187,753 | 2/1980 | Walde | 83/698 X |
| 4,207,789 | 6/1980 | Bleich | 83/700 X |
| 4,339,976 | 7/1982 | Wallis | 83/700 X |
| 4,392,402 | 7/1983 | Raun | 83/699 X |
| 4,422,359 | 12/1983 | Leboeuf | 83/546 |
| 4,594,928 | 6/1986 | Thomas et al. | 83/698 |
| 4,781,668 | 11/1988 | Mowry | 83/700 X |

FOREIGN PATENT DOCUMENTS

| | | | |
|---|---|---|---|
| 354399 | 6/1922 | Fed. Rep. of Germany | 83/700 |
| 1955429 | 2/1967 | Fed. Rep. of Germany . | |
| 1251271 | 4/1968 | Fed. Rep. of Germany . | |
| 543473 | 3/1956 | Italy | 83/700 |

*Primary Examiner*—Frank T. Yost
*Assistant Examiner*—Rinaldi Rada
*Attorney, Agent, or Firm*—Steele, Gould & Fried

[57] ABSTRACT

In a cutting mechanism (1), the cutting blade (2) is clamped against the blade support (3) by cam-like clamping members (25) arranged on a common actuating shaft (22). The clamping members (25) can be jointly adjusted by means of an actuating member (33) positioned in readily accessible manner on the front outside (30) of the cutting mechanism (1). In the vicinity of the other end, a longitudinal stop (40) for cutting blade (2) is provided, while on the end of the cutting blade (2) located at actuating member (3) is provided a mounting support (41) for a handle. Thus, even in the case of cutting mechanisms (1) closely juxtaposed in a cutting station, the cutting blade (2) can be replaced and realigned in a very short time.

55 Claims, 5 Drawing Sheets

CUTTING APPARATUS FOR SHEET MATERIAL, LIKE PAPER

This is a continuation of application Ser. No. 933,030, filed 11/20/86 now abandoned.

BACKGROUND OF THE INVENTION

The invention relates to a cutting apparatus for sheet material like paper, particularly as one of several juxtaposed cutting units of a cutting station, with at least one cutting blade mounted so that it can be reciprocated in a cutting movement with respect to a counterblade, the cutting blade being fixed by at least one clamping member in removable manner with one lateral face against a blade support. The apparatus has sides belonging to the lateral faces of the cutting blade and also outsides at right angles thereto formed by end sides belonging to the ends of the cutting blade and a longitudinal side remote from the blade edge.

Such cutting mechanisms are in particular used on production lines for exercise books, writing pads, etc, several juxtaposed, jointly functioning cutting mechanisms cutting individual portions, which then form the finished product, from strips of e.g. wire-stitched, adhesively bound or similar sheet layers. Hitherto in the case of such cutting mechanisms, the cutting blades are fixed in the blade rocker arms provided as the blade supports in such a way that in the blade, having a total length of e.g. approximately 360 mm, there are several tapholes at right angles to the cutting plane, by means of which the cutting blade is drawn against the blade rocker arm by clamp botts and is consequently fixed.

The clamp bolts pass through elongated slots in the blade rocker arm located approximately at right angles to the longitudinal direction of the cutting blade, so that the latter can be adjusted with respect to the blade rocker arm or counterblade in its position at right angles to the cutting edge. In particular with the relatively frequently occurring, relatively small useful widths, in which the cutting mechanisms or cutting blades are correspondingly closely juxtaposed, it is very difficult to obtain access to the clamp bolts, because as a result of the adjacent cutting mechanism they cannot be reached from the side of the mechanism belonging to the lateral face of the cutting blade, although their bolt heads used for actuation or operation are located on the lateral faces of the blade rocker arm. In fact, the clamp bolt heads can only be reached by passing between adjacent cutting mechanism from their end sides and this can be particularly difficult for clamp bolts located in the vicinity of the cutting blade length. The loosening of the cutting blade is relatively difficult and the fixing of a new, sharp cutting blade is even more difficult, because as a result of handling problems both the clamping moment of the clamp bolts can only be uniformly adjusted only with difficulty and the simultaneous adjustment of the cutting blade at right angles to the cutting edge is extremely difficult. Thus, blade changing is very time-consuming in the known cutting mechanisms and this leads to long machine down times. It has e.g. been found that roughly five hours are necessary for changing the blades on six blade rocker arms, which are provided for the simultaneous cutting of five portions.

SUMMARY OF THE INVENTION

The object of the invention is to provide a cutting mechanism of the aforementioned type, in which the cutting blade change is greatly simplified and as a result the precise adjustment thereof is facilitated.

This object is achieved by a cutting mechanism of the aforementioned type in that the clamping member is connected to an actuating member mounted in movable manner on the blade support and which is located in the vicinity of one of the outsides of the cutting mechanism. The term outsides in this context means all those sides of the cutting mechanism which are not the two lateral faces of the cutting blade, i.e. which are free or easily accessible even in the case of juxtaposed cutting mechanisms.

It is particularly advantageous if the actuating member is rotatably mounted about a rotation axis, which differs from the conventional position at right angles to the cutting or sectional plane of the cutting blade and is preferably approximately parallel thereto, so that very little space is required for the mounting of the actuating member. Moreover, the clamping member is rotatably mounted about a corresponding rotation axis, which is preferably equiaxial to the actuating member, which leads to a very simple and compact driving connection between actuating member and clamping member.

A particularly advantageous further development of the invention is provided by all the clamping members for a cutting blade being connected to a common actuating member and preferably arranged on a common actuating shaft, so that on the one hand all the clamping members can be released or clamped with a single actuating process and on the other hand the clamping moment for all the clamping members is always the same. If not only all the clamping members, but also the actuating member is arranged on a common actuating shaft, then the actuating member and clamping members can be successively arranged in space-saving manner along said shaft.

Although it is conceivable to mount the actuating member and optionally also the clamping member about a rotation axis roughly at right angle to the longitudinal direction of the cutting blade, so that the actuating member is accessible on the outside of the cutting mechanism remote from the cutting edge and which is generally the top edge thereof, an even simpler construction is obtained if the actuating member is located in the vicinity of one end of the mechanism, preferably that end on which the cutting blade sloping in its longitudinal direction has the maximum spacing from the counterblade and which is generally the front end of the cutting mechanism with respect to the passage direction of the sheet layers. In this case, the actuating member can be located over most of its length directly adjacent to the cutting blade.

The reproducible precision of the clamping power with which the cutting blade is clamped against the blade support, can be further improved in that the clamping member is resiliently mounted on the blade support for movement in the clamping direction and preferably the bearing bodies for the clamping member are fixed by means of at least one spring to the blade support. In order to obtain a high clamping power with a compact construction, the spring is formed by a leaf spring, particularly a leaf spring pile and is preferably arranged in a plane parallel to the sectional plane, so that it can e.g. be provided in an axial plane of the rotation axis of the clamping member or actuating member parallel to the sectional plane.

According to the invention, the actuating paths necessary for releasing or clamping the blade can be significantly reduced compared with known constructions. This is particularly possible if the clamping member is formed by a cam, e.g. an end cam or a circumferential cam, so that the clamping member need be rotated between the clamping position and the release position by a maximum of 360° and preferably only roughly 180°. If the cam is constructed in roller-like manner, then it is merely necessary to have one or two equiaxial clamping members to clamp the cutting blade uniformly against the blade support over most of its length.

In the case of short actuating paths of the clamping mechanism, and in particular if the latter cannot be adequately secured in a self-locking manner, it is advantageous for securing the clamping position if the clamping member can be locked therein. In order not to need a separate locking mechanism e.g. acting on the actuating member or actuating shaft, locking takes place directly between the clamping member and the cutting blade, i.e. the cooperating locking members are formed by the actual clamping member and the cutting blade. In a simple manner, this can be achieved if the clamping member has a locking member on its clamping face and in particular a flattened portion, with which it engages in the clamping position in secured manner on the associated lateral face of the cutting blade.

If the cutting blade has struck the blade support with its lateral face remote from the cutting or sectional plane, it is tediously necessary to compensate tolerances in the plate thickness of the cutting blade with respect to the lower blade during each blade change by readjusting the cutting mechanism with respect to the lower blade. In simple manner this can be avoided in that the cutting blade is clamped against the blade support with its preferably continuously planar lateral face located in the sectional plane. In addition thereto or instead thereof, it can also be advantageous if the clamping member as a pressure member engages on the other lateral face, so that the cutting blade need no openings over its entire extension and can have planar lateral faces throughout both sides thereof.

For the aforementioned reasons, it is very difficult to adjust the cutting blade at right angles to the longitudinal direction of the cutting edge in the hitherto known constructions. For this purpose, a setting or master gauge is required, which aligns the edge of the cutting blade with respect to a reference face of the blade rocker arm located along side one lateral face of the cutting blade. However, in the case of the invention, the reference face can be formed by an opposite or mating stop face on the blade support for the actual cutting blade and said mating stop face is appropriately associated with, or faces the edge face of the cutting blade remote from the cutting edge. If the cutting member is so constructed and mounted with reference to the cutting blade that, during its actuation, it exerts a force vector on said blade which is directed toward said mating stop face, then without particular effort it is ensured that the cutting blade remains supported in a reliably and accurately aligned manner on the mating stop face during clamping.

As the distance between the stop face of the cutting blade and its cutting edge changes or decreases during each resharpening, it is advantageous if the cutting blade stop face is formed by at least one adjusting member mounted on the cutting blade, in adjustable manner in the stop direction, and appropriately, two adjusting members distributed over the cutting blade length are provided on its edge face remote from the cutting edge. These adjusting members, which can may also be formed by cams or the like, are in a simple embodiment stop screws, can be fixed by self-locking or lock nuts and are located parallel to the stop direction or at right angles to the blade cutting edge and project over said cutting blade edge face. This makes it possible to provide a setting or master gauge on which the cutting blade or its adjusting members can be precisely preadjusted prior to fitting the cutting blade in the blade support. The gauge has stop faces for the cutting edge and the lateral face of the cutting blade to be clamped against the blade support, as well as an adjusting face for setting the adjusting members facing the engagement face for the cutting blade, in such a way that the latter, if set in engagement on said adjusting face, precisely assume the adjusting position required for fitting in the blade support.

The cutting blade can be fitted even more easily if a longitudinal stop is provided on the blade support for one of its ends, particularly for the end remote from the actuating member. A further simplification in connection with the blade change can be achieved if a mounting support for a handle, preferably a taphole located roughly in the longitudinal direction of the cutting blade is provided at at least one end of the latter, particularly at its end located at the actuating member, so that during blade change, the cutting blade can be very securely held and guided at one or both ends in each case by an easily removable handle.

It has been found that as a result of the inventive construction the blade change operation for six cutting blades in a cutting station can be reduced to approximately 15 minutes.

BRIEF DESCRIPTION OF THE DRAWINGS

The and further features of the preferred developments of the invention can be gathered from the description and drawings and the individual features can be realised singly or in the form of subcombinations in an embodiment of the invention and in other fields. The invention is described in greater detail hereinafter relative to the drawings, wherein.

DETAILED DESCRIPTION OF THE PREFERRED EMBODIMENTS

Figure 1:
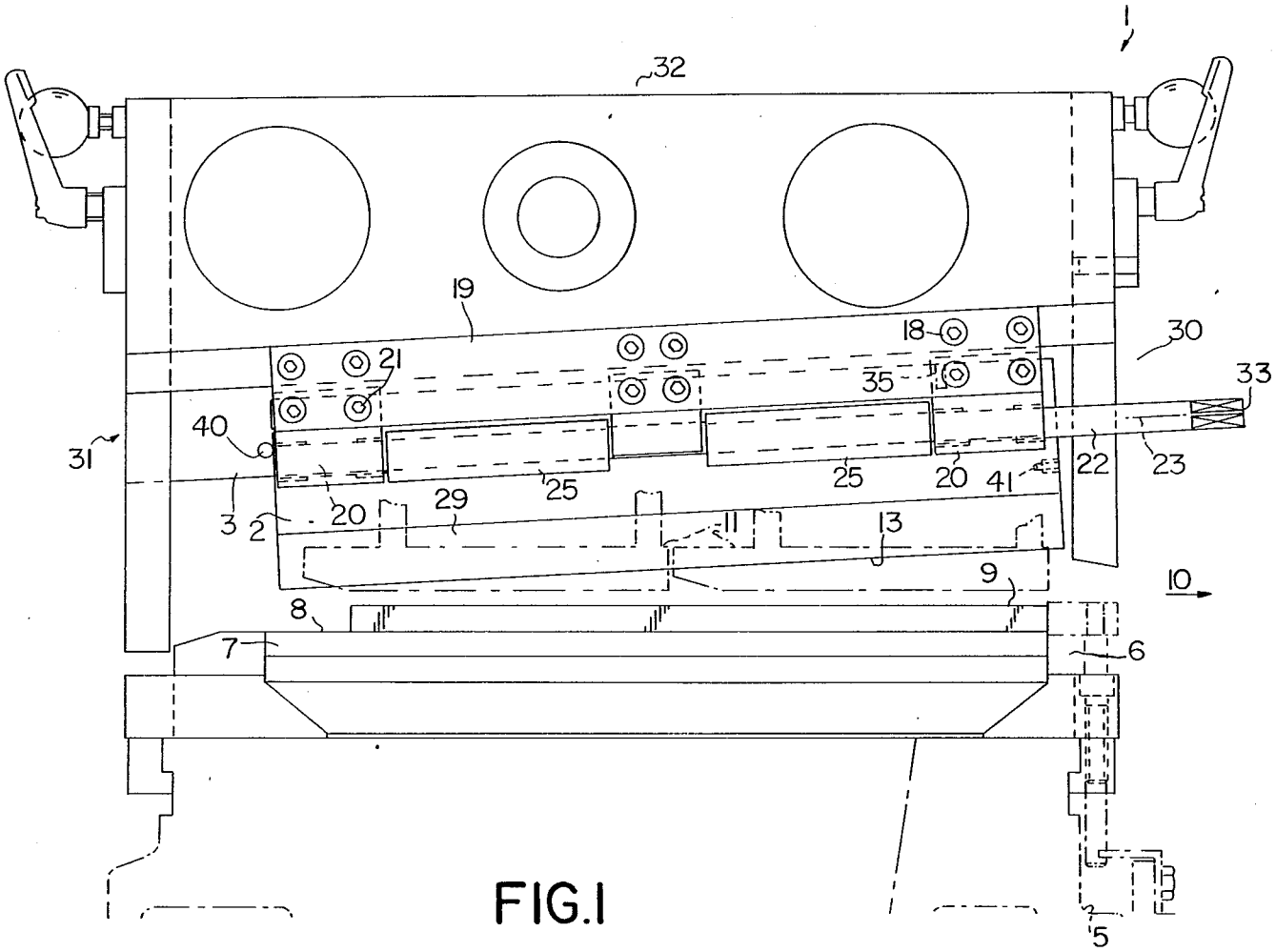
FIG. 1 is an inventive cutting mechanism in a view of one side.
Figure 2:
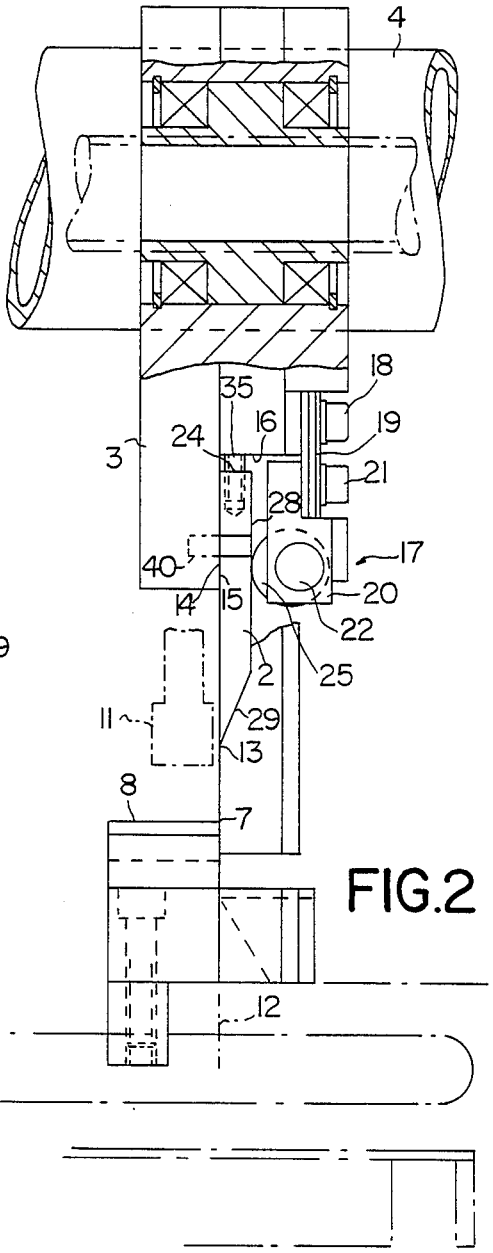
FIG. 2 is a part sectional longitudinal view of the cutting mechanism of FIG. 1.

The cutting mechanism 1 according to FIGS. 1 and 2 is intended to be arranged with identical or similar cutting mechanisms of the mounting supports on a cutting station in juxtaposed manner in the view of FIG. 2 and in aligned manner in the view of FIG. 1. Each cutting mechanism 1 has a cutting blade 2 parallel to the cutting blades of the other cutting mechanisms and located on a blade support 3 of an upper part of cutting mechanism 1, which performs the vertical cutting movement. For this purpose all the upper parts are mounted with bores on two common support rods 4, which are movably mounted in the direction of the cutting movement and are operably connected to a drive. The upper parts of the cutting mechanisms can be longitudinally displaced on these support rods 4 and fixed with respect thereto by securing toggles, so that the distance between adjacent cutting mechanisms or their cutting blades 2 can be set as required. On a machine bed 5 indicated by dot-dash lines in FIG. 1, each cutting mechanism has a lower part 6 with a or counter tool 7, serving as a lower blade, for the associated cutting blade 2, the upper face of said counterblade 7 being located in the plane of a bearing surface 8 for the sheet layers 9 to be cut and which layers are only shown in FIG. 1. The lower part 6 can be adjusted with respect to the machine bed in the same direction as the upper parts and can be secured with clamping shoes, so that each counterblade 7 can be precisely adjusted with respect to the associated cutting blade 2. The sheet layers 9, which are supplied at right angles to this adjusting direction, i.e. in the longitudinal direction of cutting blade 2 by means of a conveyor and against a lowerable stop, are then simultaneously cut by all the cutting blades 2 to the predetermined dimensions and then, in the indicated paper movement direction and after lowering the stop, are conveyed out of the cutting station in the direction of arrow 10. During cutting, the sheet layers 9 are pressed against the bearing surface 8 by holding-down devices 11 indicated in dot-dash manner in FIGS. 1 and 2 and directly adjacent to cutting blade 2, the holding-down devices 11 being located on that side of the particular cutting blade 2, which is provided in the sectional or cutting plane 12. The plate-like or strip-like cutting blades 2 rise in the direction of arrow 10 under a few radians, so that when the cutting blade 2 is in its initial position, its cutting edge 13 is located in this direction under at an acute angle to the counter blade 7.

The lateral face 14 of cutting blade 2 is located in and defines the sectional or cutting plane 12. Lateral face 14 is planar over its entire surface extension and is clamped against a clamping face 15 of the blade support 3. Blade support 3 is formed by the upper part and is located in the same plane. The longitudinal edge 24 of blade 2, remote from the cutting edge 13, has a constant distance from the cutting edge 13 over the length of the cutting blade 2 and is aligned with a mating or opposite stop face 16, at right angles to the clamping face 15, and connected to the clamping face 15. For this purpose the blade support or the upper part can be formed by adjacently sequenced plates having a stepped height, whereof the highest with the associated lateral face forms the clamping face 15 and the next one with its associated longitudinal edge face forms the mating stop face 16. All the plates are guided on the support rods 4. Both the clamping face 15 and the mating stop face 16 extend essentially over the total length of cutting blade 2.

An inventive clamping device 17 is provided for clamping the cutting blade 2 and is fixed on a surface of the upper part or the associated upper part plate, which can be the central plate of the three plates, and which is roughly parallel to the clamping face 15 and is connected to the mating stop face 16 by screws 18 or the like. The leaf springs of a three-layer leaf spring pile, which is preferably planar in the relaxed state, are fixed to screws, and said pile forms a spring 19 determining the tension of the clamping device 17, which extends parallel to the longitudinal direction of cutting blade 2 and extends roughly over its entire length. Two bearing blocks 20 are fixed to the side of spring 19 facing cutting blade 2 by screws 21 or the like. The bearing bodies 20 are located in the vicinity of the two ends of blade 2, in the form of bearing blocks provided with a stepped shoulder in longitudinal view and which engage in the stepped shoulder face of the particular bearing body 20, roughly parallel to clamping face 15 and tension spring 19, against said shoulder face. The bearing bodies 20 are immediately adjacent to the mating stop face 16 and to the cutting blade 2 and each extends slightly more deeply than stop face 15. The distance between the fastening points of spring 19 on the one hand to the blade support and on the other hand to the bearing body 20 is very small, so that even in the case of a relatively weak spring 19, a very high spring tension is obtained. According to FIG. 2, unlike in FIG. 3, spring 19 can also be approximately planar in the tensioned state.

Figure 3:
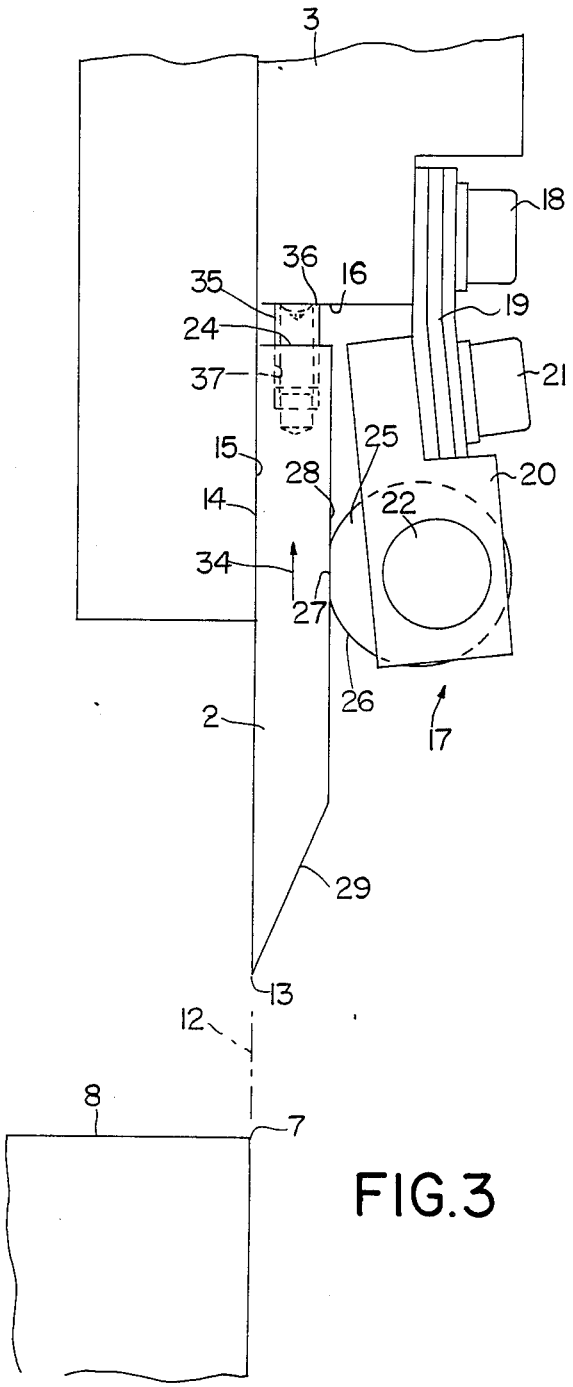
FIG. 3 shows the cutting blade clamping device of the cutting mechanism according to FIG. 2 in a larger-scale representation and in the clamped state.

Actuating means including an actuating shaft 22 and actuating member 33 move the clamping face 26 of the bearing bodies or blocks 20, toward or away from the clamping face 15 of the blade support 3. The actuating shaft 22 is mounted in the bearing blocks 20 in rotary manner about a rotation axis 23 by means of roller bearings or the like, said rotation axis being parallel to the sectional plane 12 and the longitudinal direction of cutting blade 2, and which in the side view according to FIG. 1 is provided between the cutting edge 13 and the longitudinal edge face 24 of blade 2 remote therefrom or the mating stop face 16. On the actuating shaft 22, between bearing bodies 20, are provided two spaced roller-like and identical cams 25, constructed in the manner of circumferential cams and whose reciprocal spacing is smaller than their length and whose total length is greater than half the length of cutting blade 2. The two cams 25 are appropriately constructed in one piece with the actuating shaft 22. Each cam 25 is provided on its clamping face 26, formed by its circumferential face and namely at the point of greatest eccentricity with a locking member in the form of a partly ground flattened portion 27, and which in the clamping position engages on the associated lateral face 28 of cutting blade 2 following onto the cutting edge bevel 29 under the tension of spring 19. Lateral face 28 is parallel to lateral face 14. In this secured state, spring 19 according to FIG. 3 is deflected by a few radians, in such a way that the bearing bodies 20 slope slightly. Thus, the bearing bodies 20 are exclusively carried by spring 19. For central supporting purposes between cams 25, it is possible to provide a step bearing engaging on the actuating shaft, for example in an angular fashion.

Figure 4:
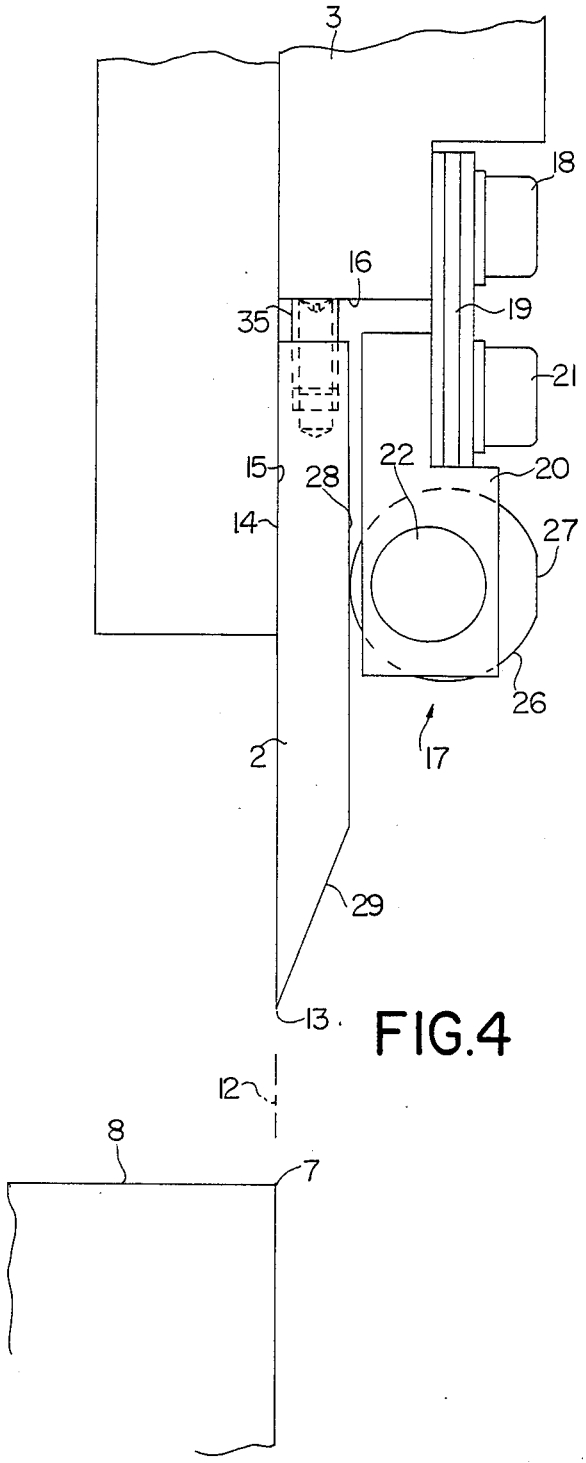
FIG. 4 shows the clamping mechanism according to FIG. 3 in the released state.
Figure 6:
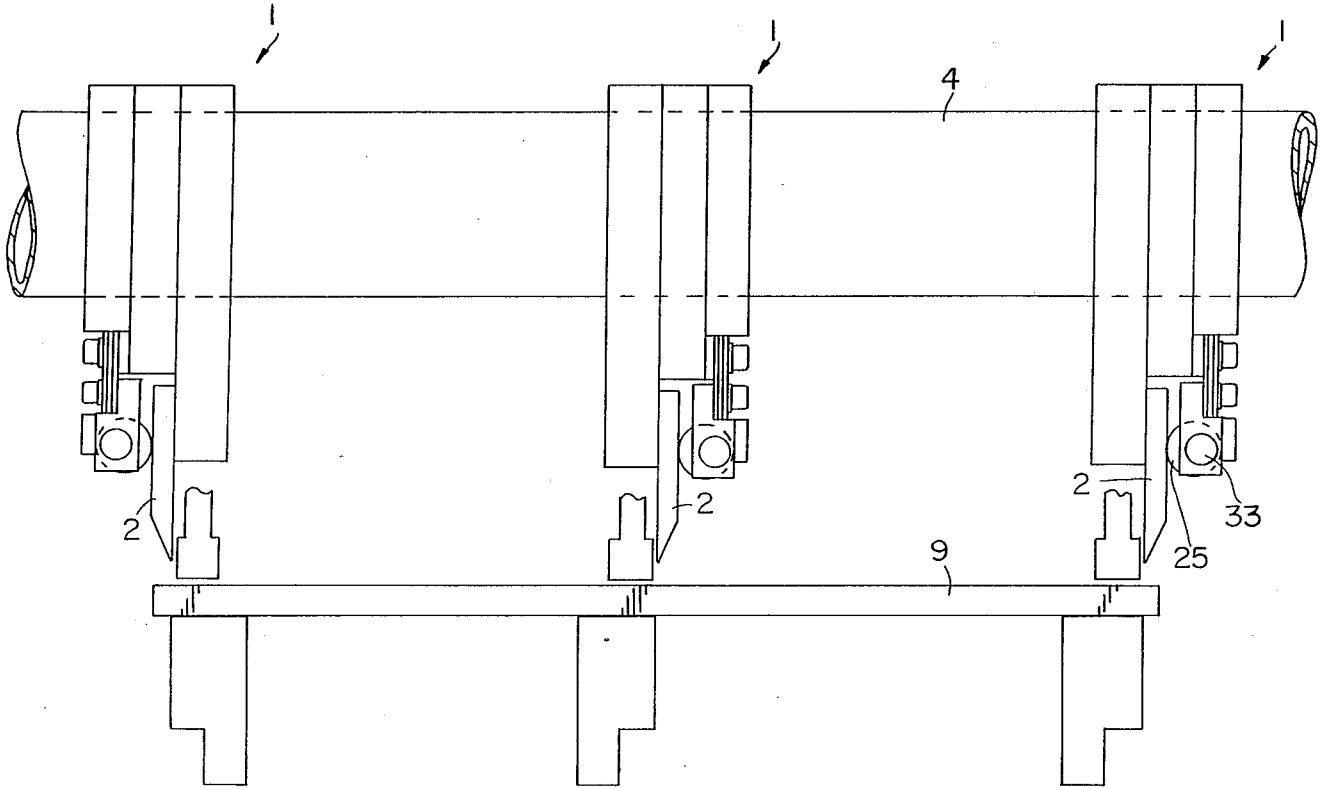
FIG. 6 is a longitudinal view corresponding to FIG. 2, but wherein the apparatus is one of several juxtaposed cutting units of a cutting station.

In the case of several juxtaposed cutting mechanisms 1 as shown in FIG. 6, their facing lateral sides cover one another and are difficult to axis, so that these sides do not form outsides of the cutting mechanism or station. Readily or freely accessible outsides are solely constituted by the front outside 30, the rear outside 31 and the top outside 32. In the represented embodiment, actuating shaft 22 extends beyond the front outside 30 and is provided on its projecting end with an actuating member 33, e.g. in the form of a square or a similar coupling member for joining to a crank handle or the like. The actuating member 33 could also be slightly set back with respect to outside 30, but is still readily accessible from outside 30. For releasing or clamping purposes, a suitable handle is mounted on actuating member 33 and is consequently coupled in such a way that it does not rotate with the actuating shaft 22. The clamping of cutting blade 2 appropriately takes place according to FIGS. 2 to 4 by turning the actuating shaft to the right, i.e. by turning clamping members 25 clockwise, so that a force vector 34 is exerted thereon by the frictional force between clamping member 25 and cutting blade 2, which urges the cutting blade towards the mating stop face 16, optionally accompanied by sliding on the stop face 15, so that a precise vertical alignment of the cutting blade is automatically ensured or at least a lowering thereof is prevented. Following the release of clamping members 25, the cutting blades 2 can be removed downwards out of the cutting mechanism or blade support 3 at right angles to the longitudinal direction thereof.

Figure 5:
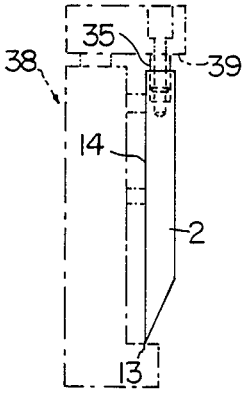
FIG. 5 is a gauge for presetting the adjusting members of the cutting blade.

For aligned engagement of the mating stop face 16, cutting blade 2 has two spaced adjusting members 35, whose stop faces are located at a distance beyond edge face 24. Adjusting members 35, which laterally extend at the most up to the plane of the lateral faces 14, 28 of cutting blade 2, are formed by studs, which are inserted in a tap hole 37 in edge face 24, the central axes of adjusting members 35 being provided at right angles to the longitudinal direction of cutting edge 13. For the preadjustment of cutting blade 2 prior to fitting in blade support 3, a master gauge 38 according to FIG. 5 is provided, which has bearing faces for the lateral face 14 of cutting blade 2 belonging to stop face 15 and a bearing face at right angles thereto for the cutting edge 13. A bearing face facing the latter bearing face serves as an adjusting face 39, against which are placed the adjusting members 35 with their bearing faces 36. In the gauge part having the adjusting face 39, it is possible to provide openings or bores, which are equiaxial to adjusting members 35 and through which it is possible to reach same with a suitable tool, e.g. a screwdriver. In the vicinity of adjusting face 39, the diameter of said opening is smaller than the external diameter of adjusting members 35, so that they can strike against adjusting face 39 in spite of the openings. The gauge part having the adjusting face 39 can, with respect to the remainder of the gauge, be adjusted and fixed at right angles to adjusting face 39, so that the master gauge can be used for different blade heights.

For the end face of cutting blade 2 remote from actuating member 33, a longitudinal stop 40 is provided on blade support 3 roughly at the height of actuating shaft 22 and said stop can in simple manner be formed by a cylindrical pin or the like projecting at right angles over stop face 15. At the front end of cutting blade 2 is also provided a mounting support 41 for a handle or the like which does not project over the lateral faces thereof and which is formed by a tap hole in the associated end face of blade 2 and which is spaced below the actuating shaft 22. For example a stick grip can be screwed into this mounting support 41 and has on its shaft end remote from the grip a corresponding threaded journal, the grip making it possible to hold the cutting blade 2 very easily when changing blades.

What is claimed is:

1. A cutting apparatus for sheet material, comprising:

a plurality of cutting blades mounted for reciprocal cutting movement with respect to countertools, each thereby defining a cutting plane, each said cutting blade having opposite ends, a cutting edge and a longitudinal edge facing in a direction opposite from the cutting edge, each said cutting blade extending lengthwise between the opposite ends and having lateral faces;

a blade support for each of the cutting blades; and, means for detachably clamping each said cutting blade to one of the blade supports with one of said lateral faces against the blade support, the clamping means comprising at least one tightening means resiliently mounted on the blade support and continuously urged in a clamping direction, the tightening means having a clamping face movable in the clamping direction, and an actuating means for moving the tightening means toward the blade support and away from the blade support, the actuating means being disposed in an access region situated at an end of the cutting edge as viewed lengthwise, whereby the actuating means is easily accessible for clamping and unclamping the cutting blade from an outer side of the cutting apparatus adjacent said end.

2. A cutting apparatus for sheet material, comprising:

at least one cutting blade mounted for reciprocal cutting movement with respect to a countertool and thereby defining a cutting plane, said cutting blade having opposite ends, a cutting edge and a longitudinal edge facing in a direction opposite from the cutting edge, the cutting blade extending lengthwise between the opposite ends and having lateral faces;

a blade support; and, means for detachably clamping said cutting blade to the blade support with one of said lateral faces against the blade support, the clamping means comprising at least one tightening means resiliently mounted on the blade support and continuously urged in a clamping direction, the tightening means having a clamping face movable in the clamping direction, and an actuating means for moving the tightening means toward the blade support and away from the blade support, the actuating means being disposed in an access region situated at an end of the cutting edge as viewed lengthwise, whereby the actuating means is easily accessible for clamping and unclamping the cutting blade from an outer side of the cutting apparatus adjacent said end.

3. A cutting apparatus according to claim 1, wherein the actuating means is mounted for rotation about an axis substantially parallel to the cutting plane and offset therefrom.

4. A cutting apparatus according to claim 1, wherein a tightening means is mounted for rotary reciprocal movement toward and away from the cutting plane about an axis substantially parallel to the cutting plane and offset therefrom.

5. A cutting apparatus according to claim 1, wherein the actuating means and the tightening means are mounted for rotation about a common axis substantially parallel to the cutting plane and offset therefrom.

6. A cutting apparatus according to claim 1, comprising a plurality of tightening means for the at least one cutting blade controlled by a common actuating means.

7. A cutting apparatus according to claim 1, comprising a plurality of tightening means arranged on the actuating member.

8. A cutting apparatus according to claim 1, wherein the actuating means is mounted for rotation about an axis substantially parallel to the longitudinal edge of the cutting blade.

9. A cutting apparatus according to claim 1, wherein the tightening means is mounted for rotary reciprocal movement about an axis substantially parallel to the longitudinal edge of the cutting blade.

10. A cutting apparatus according to claim 1, wherein the actuating means extends toward one of the opposite ends of the cutting blade.

11. A cutting apparatus according to claim 1, wherein the tightening means comprises a cam.

12. A cutting apparatus according to claim 11, wherein the cam comprises a circumferential cam.

13. A cutting apparatus according to claim 1, wherein the tightening means is roller-shaped.

14. A cutting apparatus according to claim 1, further comprising means for locking the tightening means in a tightening position.

15. A cutting apparatus according claim 14, wherein the tightening means comprises a locking member.

16. A cutting apparatus according to claim 1, wherein the tightening means has a tightening face with a flattened portion, the flattened portion engaging the lateral face of the cutting blade opposite the blade support, in a clamping position.

17. A cutting apparatus according to claim 1, wherein the lateral face of the cutting blade clamped against the blade support is located substantially in the cutting plane.

18. A cutting apparatus according to claim 17, wherein the tightening means engages the lateral face of the cutting blade opposite to the lateral face clamped against the blade support.

19. A cutting apparatus according to claim 1, wherein the tightening means comprises a pressure exerting surface which engages against the cutting blade.

20. A cutting apparatus according to claim 1, wherein the blade is movable in an advancing direction during cutting, and the tightening means bears on the cutting blade in a direction partly opposite to the advancing direction.

21. A cutting apparatus according to claim 1, further comprising at least one adjusting member mounted on the cutting apparatus and forming a stop face for positioning the cutting blade in a stopping direction opposite to the cutting edge.

22. A cutting apparatus according to claim 21, wherein the tightening means undergoes a clamping movement in the stopping direction when tightened.

23. A cutting apparatus according to claim 21, wherein the adjusting member comprises a stop screw.

24. A cutting apparatus according to claim 21, further comprising a master gauge for presetting the adjusting member.

25. A cutting apparatus according to claim 21, wherein the adjusting member projects beyond the longitudinal edge of the cutting blade.

26. A cutting apparatus according to claim 1, further comprising a longitudinal stop on the blade support for one end of the cutting blade.

27. A cutting apparatus according to claim 26, wherein the longitudinal stop is disposed at that end of the cutting blade remote from the actuating means.

28. A cutting apparatus according to claim 1, further comprising a mounting support for a handle at one end of the cutting blade.

29. A cutting apparatus according to claim 28, wherein the mounting support is a threaded bore having an axis substantially parallel to the longitudinal edge.

30. A cutting apparatus according to claim 28, wherein the mounting support is disposed at that end of the cutting blade adjacent the actuating means.

31. A cutting apparatus according to claim 1, adapted for cutting paper material.

32. A cutting apparatus for sheet material, comprising:

at least one cutting blade mounted for reciprocal cutting movement with respect to a countertool and thereby defining a cutting plane, said cutting blade having opposite ends, a cutting edge and a longitudinal edge facing in a direction opposite from the cutting edge, the cutting blade extending lengthwise between the opposite ends and having lateral faces;

a blade support; and;

means for detachably clamping said cutting blade to the blade support with one of said lateral faces against the blade support, the clamping means comprising at least two tightening means and an actuating means for the tightening means, the tightening means being resiliently mounted on the blade support and continuously urged in a clamping direction, the clamping means having a clamping face movable in the clamping direction, the actuating means being operable to move the tightening means toward the blade support and away from the blade support, all said at least two tightening means being actuated by only one said actuating means.

33. A cutting apparatus according to claim 32, wherein the actuating means is mounted for rotation about an axis substantially parallel to the cutting plane and offset therefrom.

34. A cutting apparatus according to claim 32, wherein the actuating means and the tightening means are mounted for rotation about a common axis substantially parallel to the cutting plane and offset therefrom.

35. A cutting apparatus according to claim 32, wherein the actuating means extends toward one of the opposite ends of the cutting blade, which end is positioned at an outer side of the cutting apparatus.

36. A cutting apparatus according to claim 32, wherein the tightening means comprises a cam.

37. A cutting apparatus according to claim 32, wherein the tightening means comprises a circumferential eccentric cam.

38. A cutting apparatus according to claim 37, wherein the cam is roller-shaped.

39. A cutting apparatus according to claim 32, further comprising means for locking the tightening means in a tightening position.

40. A cutting apparatus according to claim 39, wherein the tightening means comprises a locking member.

41. A cutting apparatus according to claim 32, wherein the tightening means has a tightening face with a flattened portion, the flattened face engaging the lateral face of the cutting blade opposite the blade support in a clamping position.

42. A cutting apparatus according to claim 32, wherein the tightening means engages on a lateral face of the blade opposite from a lateral face of the blade disposed against the blade support.

43. A cutting apparatus according to claim 32, wherein the blade is movable in an advancing direction during cutting and the tightening means bears on the cutting blade in a direction partly opposite to the advancing direction.

44. A cutting apparatus according to claim 32, further comprising at least one adjusting member mounted on the cutting apparatus and forming a stop face for positioning the blade in a stopping direction opposite to the cutting edge of the blade.

45. A cutting apparatus according to claim 44, wherein the adjusting member comprises a stop screw.

46. A cutting apparatus according to claim 44, further comprising a master gauge for positioning the adjusting member.

47. A cutting apparatus according to claim 32, further comprising a longitudinal stop on the blade support for fixing one end of the blade.

48. A cutting apparatus according to claim 32, further comprising a mounting support on the cutting apparatus for a handle at one end of the blade.

49. A cutting apparatus according to claim 48, wherein the mounting support is disposed at that end of the blade adjacent the actuation means.

50. A cutting apparatus for sheet material, comprising:

at least one cutting blade mounted for reciprocal cutting movement with respect to a countertool and thereby defining a cutting plane, said cutting blade having opposite ends, a cutting edge and a longitudinal edge facing in a direction opposite from the cutting edge, the cutting blade extending lengthwise between the opposite ends and having lateral faces;

a blade support;

means for detachably clamping said cutting blade to the blade support with one of said lateral faces against the blade support, the clamping means comprising at least one tightening means having a clamping face movable toward and away from the blade support, and an actuating means for the tightening means, the actuating means being operable to move the tightening means toward the blade support and away from the blade support, the actuating means being disposed in an access region situated at an end of the cutting edge as viewed lengthwise, whereby the actuating means is easily accessible for clamping and unclamping the cutting blade from an outer side of the cutting apparatus adjacent said end; and, at least one bearing body movably bearing the tightening means and spring means mounting and connecting the bearing body to the blade support.

51. A cutting apparatus according to claim 50, wherein the spring means comprises at least one leaf spring.

52. A cutting apparatus according to claim 50, wherein the spring means is arranged in a plane substantially parallel to the cutting plane.

53. A cutting apparatus for sheet material, comprising:

at least one cutting blade mounted for reciprocal cutting movement with respect to a countertool and thereby defining a cutting plane, said cutting blade having opposite ends, a cutting edge and a longitudinal edge facing in a direction opposite from the cutting edge, the cutting blade extending lengthwise between the opposite ends and having lateral faces;

a blade support; and, means for detachably clamping said cutting blade to the blade support with one of said lateral faces against the blade support, the clamping means comprising at least two tightening means with clamping faces movable toward and away from the blade support, and an actuating means for the tightening means, the actuating means being operable to move the tightening means toward the blade support and away from the blade support, all said at least two tightening means being actuated by only one said actuating means; and, at least one bearing body for the tightening means and spring means for fixing the bearing body to the blade support.

54. A cutting apparatus according to claim 53, wherein the spring means comprises at least one leaf spring.

55. A cutting apparatus according to claim 53, wherein the spring means is arranged in a plane substantially parallel to the cutting plane.

* * * * *